US006319143B1

(12) United States Patent
Collins

(10) Patent No.: US 6,319,143 B1
(45) Date of Patent: Nov. 20, 2001

(54) BOWLING/COUNT DOWN GAME

(76) Inventor: Craig K. Collins, 600 S. Easy St., Lecanto, FL (US) 34461

( * ) Notice: Subject to any disclaimer, the term of this patent is extended or adjusted under 35 U.S.C. 154(b) by 0 days.

(21) Appl. No.: 09/728,726

(22) Filed: Dec. 1, 2000

(51) Int. Cl.[7] ..... A63D 3/00
(52) U.S. Cl. ..... 473/54
(58) Field of Search ..... 473/54, 70, 71

(56) References Cited

U.S. PATENT DOCUMENTS 4,597,575 * 7/1986 Kosof .
4,834,379 * 5/1989 Brim .
4,834,381 * 5/1989 Brim .
4,930,775 * 6/1990 Hoffman .
6,017,278 * 1/2000 Benko .

* cited by examiner

*Primary Examiner*—William M. Pierce

(57) ABSTRACT

A bowling game method comprising the steps of: setting up ten pins in a conventional manner for a first player prior to initiating play; the player rolling a single first ball and knowing down a first number of pins; setting up the pins again in a conventional manner for the player before continuing; the player then rolling a single second ball and knowing down a second number of pins and then terminating play of the player if the number of pins knocked down by the second ball corresponds to the number of pins knocked down by the previous ball; setting up the ten pins again and again in a conventional manner for the player before continuing; and the player rolling a single third ball and then subsequent balls up to ten so long as the number of pins knocked down by any one ball does not correspond to the number of pins knocked down by any other prior ball by the player and continuing the recording the number of pins knocked down by each ball.

6 Claims, 2 Drawing Sheets

| NAME | 1 | 2 | 3 | 4 | 5 | 6 | 7 | 8 | 9 | 10 | PTS |
|---|---|---|---|---|---|---|---|---|---|---|---|
| BILL | 3 | 2 | 4 | 5 | 3 | | | | | | LOSE |
| SUE | 2 | 3 | 9 | 4 | 1 | 6 | 8 | 10 | 5 | 7 | WIN |

| NAME | 1 | 2 | 3 | 4 | 5 | 6 | 7 | 8 | 9 | 10 | PTS |
|---|---|---|---|---|---|---|---|---|---|---|---|
| BILL | 10 | 9 | 8 | 7 | 6 | 5 | 4 | 3 | 2 | 1 | WIN |
| SUE | 1 | 2 | 3 | 4 | 5 | 6 | 7 | 8 | 9 | 10 | WIN |

FIG 1
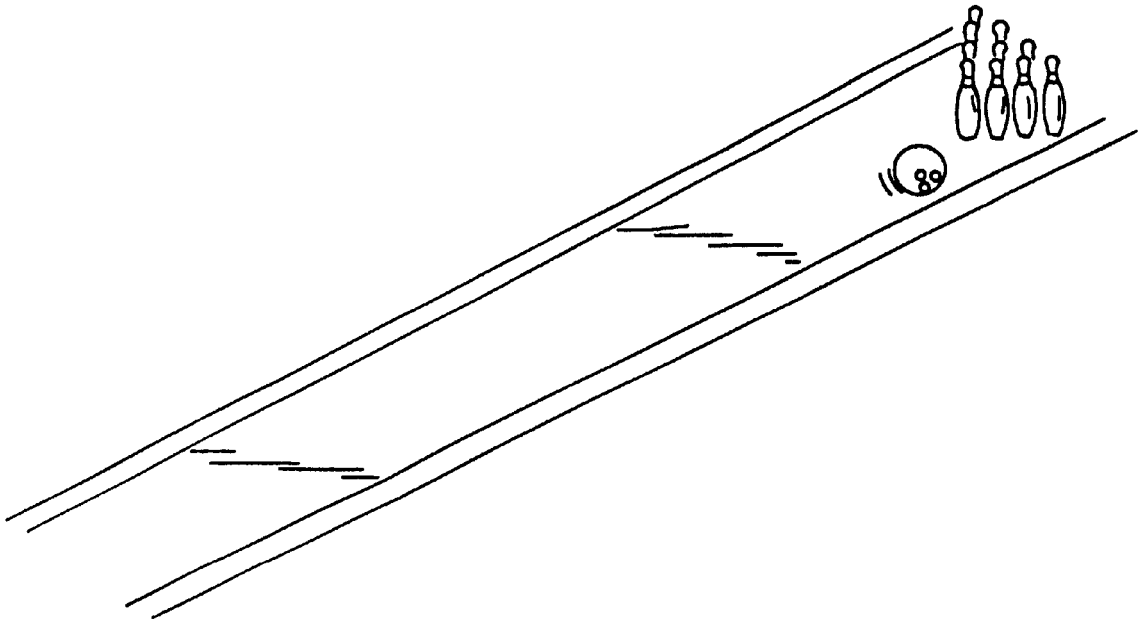
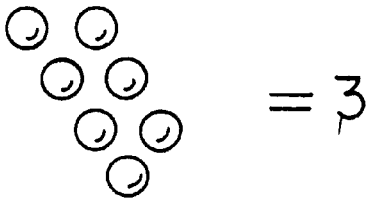
FIG 2

FIG 3

| NAME | 1 | 2 | 3 | 4 | 5 | 6 | 7 | 8 | 9 | 10 | PTS |
|---|---|---|---|---|---|---|---|---|---|---|---|
| BILL | 3 | 2 | 4 | 5 | 3 | | | | | | LOSE |
| SUE | 2 | 3 | 9 | 4 | 1 | 6 | 8 | 10 | 5 | 7 | WIN |

| NAME | 1 | 2 | 3 | 4 | 5 | 6 | 7 | 8 | 9 | 10 | PTS |
|---|---|---|---|---|---|---|---|---|---|---|---|
| BILL | 10 | 9 | 8 | 7 | 6 | 5 | 4 | 3 | 2 | 1 | WIN |
| SUE | 1 | 2 | 3 | 4 | 5 | 6 | 7 | 8 | 9 | 10 | WIN |

FIG 4

BOWLING/COUNT DOWN GAME

BACKGROUND OF THE INVENTION

1. Field of the Invention

The present invention relates to a bowling game and more particularly pertains to continuing rolling bowling balls for ten balls or less until the player knocks down the number of pins which he or she has knocked down by a prior ball.

2. Description of the Prior Art

Bowling games of known designs and configurations are known in the prior art. More specifically, bowling games of known designs and configurations previously devised and utilized for the purpose of playing bowling games, scoring and competing through known methods and apparatus are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,834,381 to Brim relates to a Bowling Game Using Sets of Predetermined Pin Fall Objectives. U.S. Pat. No. 4,597,575 to Kosof relates to a Method of Playing a Bowling Game. Lastly, U.S. Pat. No. 6,017,278 to Benko relates to a Method of Playing a Bowling Game.

While these devices fulfill their respective, particular objectives and requirements, the aforementioned patents do not describe continuing rolling bowling balls for ten balls or less until the player knocks down the number of pins which he or she has knocked down by a prior ball.

In this respect, the bowling game according to the present invention substantially departs from the conventional concepts and designs of the prior art, and in doing so provides continuing rolling bowling balls for ten balls or less until the player knocks down the number of pins which he or she has knocked down by a prior ball.

Therefore, it can be appreciated that there exists a continuing need for a new and improved bowling game wherein a player continues rolling bowling balls for ten balls or less until the player knocks down the number of pins which he or she has knocked down by a prior ball. In this regard, the present invention substantially fulfills this need.

SUMMARY OF THE INVENTION

In view of the foregoing disadvantages inherent in the known types of bowling games of known designs and configurations now present in the prior art, the present invention provides an improved bowling game. As such, the general purpose of the present invention, which will be described subsequently in greater detail, is to provide a new and improved bowling game and method which has all the advantages of the prior art and none of the disadvantages.

To attain this, the present invention essentially comprises a bowling game in which a player continues for ten balls or less until the player knocks down the number of pins which he or she has knocked down by a prior ball. A plurality of steps are included. First, prior to initiating play, ten pins are set up in a conventional manner. Then, a player rolls a single first ball and knocks down a first number of pins. The player then records on a pad the number of pins knocked down. Then, before continuing, the pins are set up again in a conventional manner. The player then rolls a second ball and knocks down a second number of pins. The player then records on the pad the number of pins knocked down. The play of the player is then terminated if the number of pins knocked down by the second ball corresponds to the number of pins knocked down by any previous ball. Then, before continuing, the pins are against set up in a conventional manner. The player rolls a third ball and subsequent balls up to ten so long as the number of pins knocked down by any ball does not correspond to the number of pins knocked down by any other prior ball by the player. The number of pins knocked down by each ball is recorded. Any time after rolling the first ball, or any subsequent ball, the player may elect to stop playing and accept a prize in direct proportion to the number of balls rolled prior to stopping or, in the alternative continue and possibly become a loser if a subsequent ball knocks down the number of pins corresponding to a prior ball. Then, a special bonus is awarded to the player if he or she knocks down pins for ten balls in a continuous sequence from ten pins followed by nine pins followed by eight pins followed by seven pins followed by six pins followed by five pins followed by four pins followed by three pins followed by two pins followed by one pin or in the alternative, one pin followed by two pins followed by three pins followed by four pins followed by five pins followed by six pins followed by seven pins followed by eight pins followed by nine pins followed by ten pins.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bowling game which has all of the advantages of the prior art bowling games of known designs and configurations and none of the disadvantages.

It is another object of the present invention to provide a new and improved bowling game which may be easily and efficiently manufactured and marketed.

It is further object of the present invention to provide a new and improved bowling game which is of durable and reliable constructions.

An even further object of the present invention is to provide a new and improved bowling game which is susceptible of a low cost of manufacture with regard to both materials and labor, and which accordingly is then susceptible of low prices of sale to the consuming public, thereby making such bowling game economically available to the buying public.

Even still another object of the present invention is to provide a bowling game for continuing rolling bowling balls for ten balls or less until the player knocks down the number of pins which he or she has knocked down by a prior ball.

Lastly, it is an object of the present invention to provide a new and improved bowling game method comprising the steps of: setting up ten pins in a conventional manner for a player prior to initiating play; the player rolling a single first ball and knowing down a first number of pins; setting up the pins again in a conventional manner for the player before continuing; the player then rolling a single second ball and knowing down a second number of pins and then terminating play of the player if the number of pins knocked down by the second ball corresponds to the number of pins knocked down by the previous ball; setting up the ten pins again and again in a conventional manner for the player before continuing; and the player rolling a single third ball and then subsequent balls up to ten so long as the number of pins knocked down by any one ball does not correspond to the number of pins knocked down by any other prior ball by the player and continuing the recording the number of pins knocked down by each ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a bowling ball being rolled toward a plurality of pins on a lane.

FIG. 2 is a top plan view of the pins illustrating the remaining pins after three pins have been knocked down with seven remaining.

FIG. 3 is illustration of a line score with two players wherein one player has terminated play by rolling a fifth ball knocking down a number of pins corresponding to a prior ball while the other play has continued to knock down different number of pins for ten frames.

FIG. 4 is an illustration of a line score where two players have played and each has rolled ten balls knocking down differing number of pins for each ball with the number of knocked down pins being in sequence.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved bowling game embodying the principles and concepts of the present invention.

The preferred embodiment of the present invention, the bowling/countdown game is played as follows:

A player continues to roll up to ten balls until he or she knocks down the number of pins which have been knocked down by a prior ball. In the primary application, the following steps are included.

Prior to initiating play, ten pins are set up in a conventional manner for the player.

Next, a player rolls a single first ball and knocks down a first number of pins. The player then records on a pad the number of pins knocked down.

Next, before continuing, the pins are again set up in a conventional manner for the player.

Next, the player then rolls a single second ball and knocks down a second number of pins. The player then records on the pad the number of pins knocked down. The play of the player is then terminated if the number of pins knocked down by the second ball corresponds to the number of pins knocked down by the previous ball.

Next, before continuing, the ten pins are again and again set up in a conventional manner for the player.

Next, the player rolls a single third ball and the subsequent balls up to ten so long as the number of pins knocked down by any one ball does not correspond to the number of pins knocked down by any other prior ball by the player. The number of pins knocked down by each ball is recorded.

Any time after rolling the first ball, or any subsequent ball, the player may elect to stop playing and accept a prize in direct proportion to the number of balls rolled prior to stopping or, in the alternative, continue and possibly become a loser if a subsequent ball knows down the number of pins corresponding to a prior ball.

Finally, a special bonus is awarded to the player if he or she knocks down pins for ten balls in a continuous sequence from ten pins followed by nine pins followed by eight pins followed by seven pins followed by six pins followed by five pins followed by four pins followed by three pins followed by two pins followed by one pin or in the alternative, one pin followed by two pins followed by three pins followed by four pins followed by five pins followed by six pins followed by seven pins followed by eight pins followed by nine pins followed by ten pins.

The game is played by rolling a single bowling ball at a full rack of ten pins and getting a pin count. For example; assume the player first rolls a seven count. Such player would then repeat the process, only he or she must get a number other than seven or the game/contest is over. Every time a player rolls a ball, such player must get a different count until the player has gotten all the numbers between 1 and 10 without any duplication.

At any time any duplicate pin count would mean the end of the game for such player. For example, assume someone gets a 7, then a 9, then a 6, then an 8, then a 6 again, the game-contest is then over since a 6 count was repeated. The whole idea is to reward people as they get further along in the count with a very large prize if they make it all the way through.

A proposed name of this contest/game would be "Countdown". Countdown could have a few variables to adapt to T.V. format. Such as risk versus reward. For example, halfway through would be worth $4,000—would someone risk it for $8,000 to take the next shot?

A player might go for higher rewards if pins were knocked down in the exact order say 10, 9, 8, 7, 6, 5, 4, 3, 2, 1. The game could allow a professional to take a shot. The appeal, besides the money, is that there are more bowlers from all walks of life than all the rest of sports activities combined. A bowler of any average or any intelligence could win it all! And while it seems easy, because anyone could do it, it is much harder than bowling a 300 game.

As an alternate embodiment of the invention, the game could be played by two players. In such embodiment the game is played as follows:

A player continues to roll up to ten balls until he or she knocks down the number of pins which have been knocked down by a prior ball. In this alternate embodiment, the following steps are included.

Prior to initiating play, ten pins are set up in a conventional manner for the first player.

Next, a first player rolls a single first ball and knocks down a first number of pins. The player then records on a pad the number of pins knocked down.

Next, before continuing, the pins are set up again in a conventional manner for a second player.

Next, a second player then rolls a single first ball and knocks down a first number of pins. The second player then records on a pad the number of pins knocked down.

Next, before continuing, the pins are again set up in a conventional manner for the first player.

Next, the first player then rolls a single second ball and knocks down a second number of pins. The first player then records on the pad the number of pins knocked down. The play of the first player is then terminated if the number of pins knocked down by the second ball corresponds to the number of pins knocked down by the previous ball.

Next, before continuing, the pins are against set up in a conventional manner for the second player.

Next, the second player then rolls a single second ball and knocks down a second number of pins. The second player then records on the pad the number of pins knocked down. The play of the second player is terminated if the number of pins knocked down by the second ball corresponds to the number of pins knocked down by the previous ball.

Next, before continuing, the ten pins are again and again set up in a conventional manner for the first player.

Next, the first player rolls a single third ball and the subsequent balls up to ten so long as the number of pins knocked down by any one ball does not correspond to the number of pins knocked down by any other prior ball by the first player. The number of pins knocked down by each ball is recorded.

Next, before continuing, the pins are again and again set up in a conventional manner for the second player.

Next, the second player rolls a single third ball and subsequent balls up to ten so long as the number of pins knocked down by any ball does not correspond to the number of pins knocked down by any other prior ball by the second player. The number of pins knocked down by each ball is recorded.

Next, the two players continue to roll single balls alternating between the first and second players until all such players have been eliminated by the knocking down of the number of pins equivalent to the number of pins from any prior ball by such player.

Next, a winner is identified on the basis of the number of balls rolled in a continuous sequence so long as the number of pins knocked down does not correspond to a previous number of pins knocked down by such player.

Finally, a special bonus is awarded to any player who knocks down pins for ten balls in a continuous sequence from ten pins followed by nine pins followed by eight pins followed by seven pins followed by six pins followed by five pins followed by four pins followed by three pins followed by two pins followed by one pin or in the alternative, one pin followed by two pins followed by three pins followed by four pins followed by five pins followed by six pins followed by seven pins followed by eight pins followed by nine pins followed by ten pins.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bowling/count down game wherein a player continues to roll up to ten balls until he or she knocks down the number of pins which have been knocked down by a prior ball comprising, in combination, the following steps:

setting up ten pins in a conventional manner for the player prior to initiating play;

the player rolling a single first ball and knocking down a first number of pins and then recording on a pad the number of pins knocked down;

setting up the pins again in a conventional manner for the player before continuing;

the player then rolling a single second ball and knocking down a second number of pins and then recording on the pad the number of pins knocked down pins and then terminating play of the player if the number of pins knocked down by the second ball corresponds to the number of pins knocked down by the previous ball;

setting up the ten pins again and again in a conventional manner for the player before continuing;

the player rolling a single third ball and then subsequent balls up to ten so long as the number of pins knocked down by any one ball does not correspond to the number of pins knocked down by any other prior ball by the player and continuing the recording the number of pins knocked down by each ball;

any time after rolling the first ball, or any subsequent ball, the player may elect to stop playing and accept a prize in direct proportion to the number of balls rolled prior to stopping or, in the alternative, continue and possibly become a loser if a subsequent ball knocks down the number of pins corresponding to a prior ball; and awarding a special bonus to the player if he or she knocks down pins for ten balls in a continuous sequence from ten pins followed by nine pins followed by eight pins followed by seven pins followed by six pins followed by five pins followed by four pins followed by three pins followed by two pins followed by one pin, or in the alternative, one pin followed by two pins followed by three pins followed by four pins followed by five pins followed by six pins followed by seven pins followed by eight pins followed by nine pins followed by ten pins.

2. A bowling game method comprising:

setting up ten pins in a conventional manner for a first player prior to initiating play;

the player rolling a single first ball and knowing down a first number of pins;

setting up the pins again in a conventional manner for the player before continuing;

the player then rolling a single second ball and knowing down a second number of pins and then terminating play of the player if the number of pins knocked down by the second ball corresponds to the number of pins knocked down by the previous ball;

setting up the ten pins again and again in a conventional manner for the player before continuing; and the player rolling a single third ball and then subsequent balls up to ten so long as the number of pins knocked down by any one ball does not correspond to the number of pins knocked down by any other prior ball by the player and continuing the recording the number of pins knocked down by each ball.

3. The method as set forth in claim 2 wherein the game is played by a single player.

4. The method as set forth in claim 2 wherein the game is played by a plurality of players alternating the rolling of balls.

5. The method as set forth in claim 2 wherein a special bonus is awarded to a player who rolls ten consecutive balls with ten different pin counts.

6. A bowling/count down game wherein a player continues to roll up to ten balls until he or she knocks down the number of pins which have been knocked down by a prior ball comprising, in combination, the following steps:

setting up ten pins in a conventional manner for the first player prior to initiating play;

a first player rolling a single first ball and knocking down a first number of pins and then recording on a pad the number of pins knocked down;

setting up the pins again in a conventional manner for the second player before continuing;

a second player then rolling a single first ball and knocking down a first number of pins and recording on a pad the number of pins knocked down;

setting up the pins again in a conventional manner for the first player before continuing;

the first player then rolling a single second ball and knocking down a second number of pins and then recording on the pad the number of pins knocked down pins and then terminating play of the first player if the number of pins knocked down by the second ball corresponds to the number of pins knocked down by the previous ball;

setting up the pins again in a conventional manner for the second player before continuing;

the second player then rolling a single second ball and knocking down a second number of pins and then recording on the pad the number of pins knocked down and then terminating play of the second player if the number of pins knocked down by the second ball corresponds to the number of pins knocked down by the previous ball;

setting up the ten pins again and again in a conventional manner for the first player before continuing;

the first player rolling a single third ball and then subsequent balls up to ten so long as the number of pins knocked down by any one ball does not correspond to the number of pins knocked down by any other prior ball by the first player and continuing the recording the number of pins knocked down by each ball;

setting up the pins again and again in a conventional manner for the second player before continuing;

the second player rolling a single third ball and subsequent balls up to ten so long as the number of pins knocked down by any ball does not correspond to the number of pins knocked down by any other prior ball by the second player and continuing the recording the number of pins knocked down by each ball;

continuing to roll single balls alternating between the first and second players until all such players have been eliminated by the knocking down of the number of pins equivalent to the number of pins from any prior ball by such player;

identifying a winner on the basis of the number of balls rolled in a continuous sequence so long as the number of pins knocked down does not correspond to a previous number of pins knocked down by such player;

any time after rolling the first ball, or any subsequent ball, any player may elect to stop playing and accept a prize in direct proportion to the number of balls rolled prior to stopping or, in the alternative, continue and possibly become a loser if a subsequent ball knocks down the number of pins corresponding to a prior ball; and awarding a special bonus to any player who knocks down pins for ten balls in a continuous sequence from ten pins followed by nine pins followed by eight pins followed by seven pins followed by six pins followed by five pins followed by four pins followed by three pins followed by two pins followed by one pin, or in the alternative, one pin followed by two pins followed by three pins followed by four pins followed by five pins followed by six pins followed by seven pins followed by eight pins followed by nine pins followed by ten pins.

* * * * *